US009251770B1

(12) United States Patent
Tsuchida

(10) Patent No.: US 9,251,770 B1
(45) Date of Patent: Feb. 2, 2016

(54) MULTI-STAGED CAM ASSEMBLY FOR DRUM PEDAL

(71) Applicant: Michihiro Tsuchida, Tokyo (JP)

(72) Inventor: Michihiro Tsuchida, Tokyo (JP)

( * ) Notice: Subject to any disclaimer, the term of this patent is extended or adjusted under 35 U.S.C. 154(b) by 0 days.

(21) Appl. No.: 14/521,902

(22) Filed: Oct. 23, 2014

(30) Foreign Application Priority Data

Aug. 27, 2014 (JP) ..... 2014-172781

(51) Int. Cl.
*G10D 13/02* (2006.01)
*G10D 13/00* (2006.01)

(52) U.S. Cl.
CPC ..... *G10D 13/006* (2013.01)

(58) Field of Classification Search
CPC ..... G10D 13/006
See application file for complete search history.

(56) References Cited

U.S. PATENT DOCUMENTS 5,398,584 A * 3/1995 Liao ..... G10D 13/006 84/422.1
5,540,131 A * 7/1996 Shigenaga ..... G10D 13/006 84/422.1
5,714,701 A * 2/1998 Hsieh ..... G10D 13/006 84/422.1
5,936,177 A * 8/1999 Shigenaga ..... G10D 13/006 84/422.1
6,172,291 B1 1/2001 Takegawa
6,894,210 B1 * 5/2005 Lombardi ..... G10D 13/006 84/422.1
6,903,257 B2 * 6/2005 Yun ..... G10D 13/006 84/422.1
7,579,539 B2 * 8/2009 Chen ..... G10D 13/006 84/411 R
7,579,540 B2 * 8/2009 Takegawa ..... G10D 13/006 84/422.1
7,858,861 B1 * 12/2010 Chen ..... G10D 13/006 84/422.1
7,956,268 B1 * 6/2011 Liao ..... G10D 13/006 84/422.1
8,455,746 B2 * 6/2013 Johnston ..... G10D 13/006 84/422.1
8,748,721 B2 * 6/2014 Hirasawa ..... G10D 13/006 84/422.1
8,779,264 B2 * 7/2014 Meyerson ..... G10D 13/006 84/422.1
2004/0060421 A1 4/2004 Yun

FOREIGN PATENT DOCUMENTS

JP 2004069843 A 3/2004

* cited by examiner

*Primary Examiner* — Robert W Horn
(74) *Attorney, Agent, or Firm* — Symbus Law Group, LLC; Clifford D. Hyra

(57) ABSTRACT

A multi-staged cam assembly comprises a connecting element 1 secured to a tip of a stamping pedal 2; a cam 10 of which a front end is secured to the other end of the element 1, wherein the element 1 is guided along an outer periphery of the cam 10; a drive shaft 6 to which a drum beating rod 5 is fixed; and a revolving body 3 comprising a boss 14 and a space keeping plate 16, wherein a hole 7 for the drive shaft 6 is formed in the boss 14. An elongated hole 17 is formed in the middle of the plate 16. A bolt 22 is inserted in the hole 17 and screwed in a screw hole 21 in the front face of the cam 10, such the cam 10 is fixed at a desired position. A length from the center of the hole 7 of the boss 14 to the back end of the cam 10 is varied in a multi-staged way according to the fixed position of the bolt 22 in the hole 17.

4 Claims, 6 Drawing Sheets

MULTI-STAGED CAM ASSEMBLY FOR DRUM PEDAL

This application claims the benefit of Japanese Patent Application No. 2014-172781, filed Aug. 27, 2014, which is hereby incorporated by reference in its entirety.

FIELD OF INVENTION

The present invention relates to a multi-staged cam assembly for a drum pedal manipulated by a drum player.

RELATED BACKGROUND ARTS

A drummer, as a user of a drum system, beats a plurality of drums holding sticks in both hands and at the same time beats a bass drum by stamping a drum pedal with a foot or both feet during a performance, so that characteristic beating sounds are generated.

Since when the drummer plays the bass drum usually a drum pedal comprising mechanical devices (see for example, Ref.1, Ref.2 and Ref.3) is stamped with foot or feet, it is difficult for the drummer to adjust the beating force against the bass drum.

REFERENCE LIST

Ref.1: U.S. Pat. No. 6,903,257 B2
Ref.2: U.S. Pat. No. 6,172,291 B1
Ref.3: U.S. Pat. No. 6,894,210 B1

SUMMARY OF THE INVENTION

The drum pedal in Ref.1 employs an eccentrically adjustable cam system, where a length of the chain as a connecting element is changed via one of four grooves of a positioning member. The drum pedal assembly in Ref.2 employs interchangeable cam elements, where variously shaped cam elements are changed in order to attain a proper eccentricity in the drum pedal assembly. In the adjustable drum beating apparatus disclosed in Ref.3, since a position of the upper end of the chain fixed to the hub adjuster part does not change relative to the hub, "a foot board angle" is changed (increased) when the eccentricity of the hub is adjusted, so that the foot board angle must be re-adjusted by using another independent mechanism.

The present invention is made in view of the above-mentioned problems in order to provide a multi-staged cam assembly for a drum pedal, where the foot board angle is not changed too much by configuring to move the upper end of a chain and a movable cam body circularly downward together.

Further, another objective of the present invention is to provide a multi-staged cam assembly for a drum pedal capable of quickly adjusting the eccentricity with one hand without difficulties.

The above-mentioned problems are solved by one of the following configurations.

(1) A multi-staged cam assembly for drum pedal, comprising: a connecting element of which one end is secured to a tip of a stamping pedal; an arc shaped cam of which a front end is secured to the other end of the connecting element, wherein the connecting element is guided along an outer peripheral surface of the cam; a drive shaft to which a drum beating rod is fixed; and a revolving body comprising a boss and a space keeping plate which restricts the cam from moving forward, wherein a hole through which the drive shaft passes is formed in the center of the boss; wherein: an elongated hole is formed in the middle of the space keeping plate; a screw hole is formed in the front face of the cam at a position corresponding to the elongated hole of the space keeping plate; a bolt is inserted in the elongated hole and screwed in the screw hole of in the front face of the cam, such the cam is fixed at a desired position; and a length from the center of the hole of the boss to the back end of the cam is varied in a multi-staged way according to the fixed position of the bolt in the elongated hole.

(2) The multi-staged cam assembly according to (1), wherein: a plurality of grooves with a concave-convex pattern are formed on the front face of the space keeping plate; a plurality of counterpart grooves to be engaged with the grooves are formed on an adjusting plate to be attached to the front face of the space keeping plate; and the bolt is screwed in the screw hole of the front face of the cam after being inserted in a hole formed in the adjusting plate and in the elongated hole of the space keeping plate so as to fix the bolt.

(3) The multi-staged cam assembly according to (1), wherein: the inner peripheral surface of the cam is formed so as to be engaged with the outer peripheral surface of the boss.

(4) The multi-staged cam assembly according to (1), wherein: a pressed coil spring is arranged between the inner peripheral surface of the cam and the outer peripheral surface of the boss.

Since the drum beating force can be varied by adjusting a length from the center of the hole of the boss to the back end of the cam as changing a position of the adjusting bolt along the elongated hole in the adjusting plate, the drummer can determine the position by himself. The position can be easily determined by merely moving the adjusting bolt with one hand to a desired position along the elongated hole after loosening the bolt and then tightening the bolt.

Since the desired position is determined by engaging the grooves with the counterpart grooves and fixing the position, the foot board angle in not changed too much and the position is not changed during the performance.

Since the pressured coil spring is arranged between the arc cam and the boss, the arc cam can be moved rotatably without difficulties.

Further, since rotatable movements of the arc cam are regulated by the guide pins properly, the position is determined rapidly.

EMBODIMENTS OF THE PRESENT INVENTION

Figure 1:
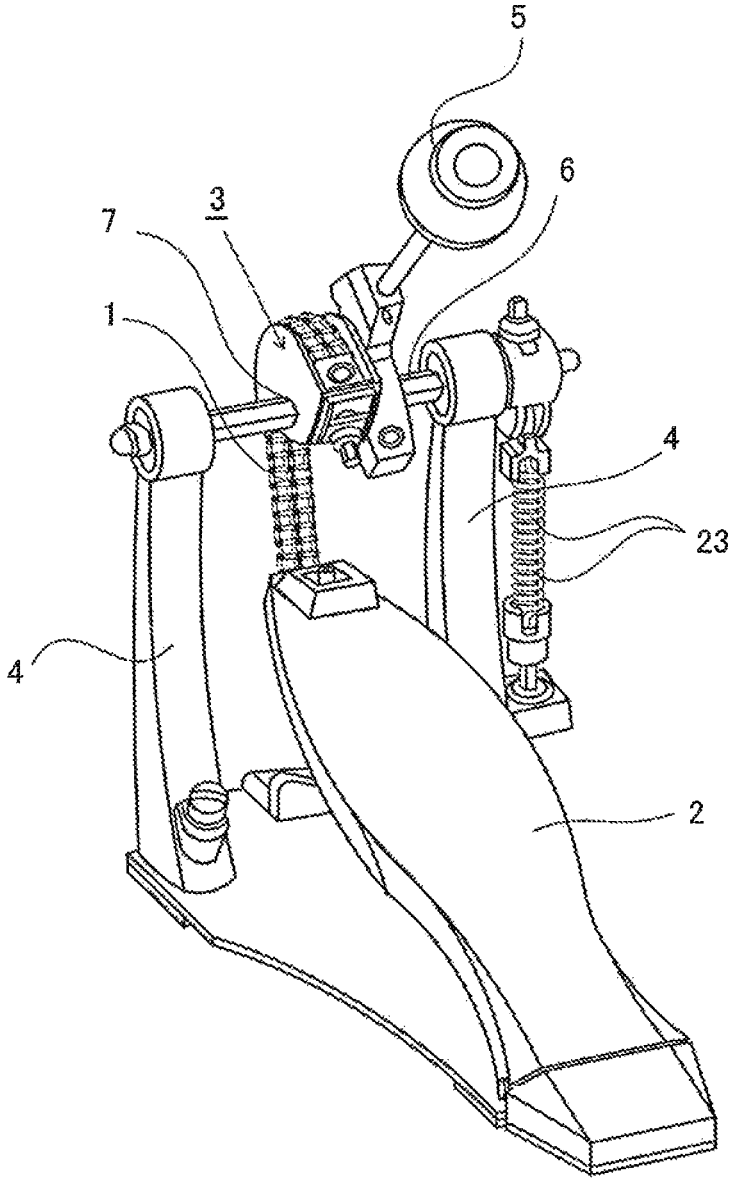
FIG. 1 is a perspective view showing an embodiment of the multi-staged cam assembly for a drum pedal according to the present invention.

Hereinafter, embodiments of the present invention are explained as referring to drawings.

A reference numeral "1" is a chain, as a connecting element, of which end is secured to a tip of a stamping pedal 2. A reference numeral "3" is a revolving body 3 comprising a center boss 14, a drive shaft 6 and side plates 8, 8 which hold the center both 14 from both sides (see FIG. 4). A hole 7, thorough which the drive shaft 6 passes, is formed in the center of the boss 14 (see FIG. 2). A drum beating rod 5 is fixed to the drive shaft 6 which is rotatably held by two supporting bodies 4, 4.

Figure 2A:
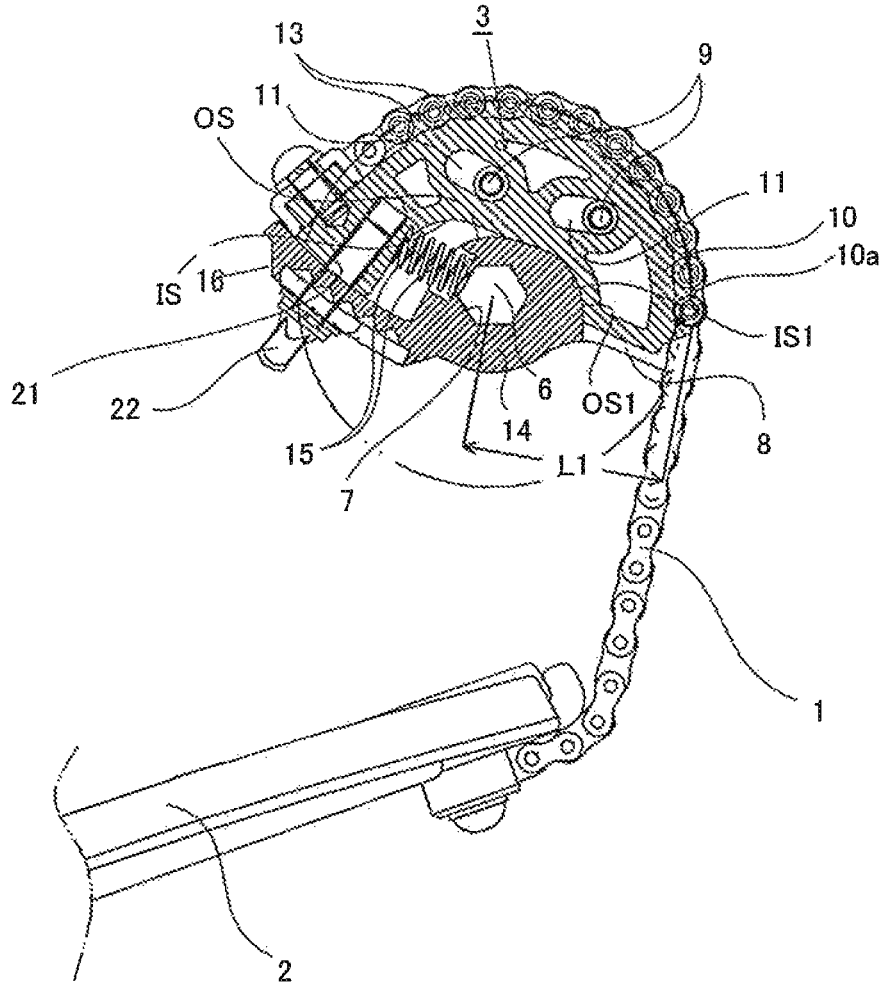
FIG. 2*a* is a sectional view of the multi-staged cam assembly with a minimum cam displacement from a driving shaft of a drum beater.
Figure 2B:
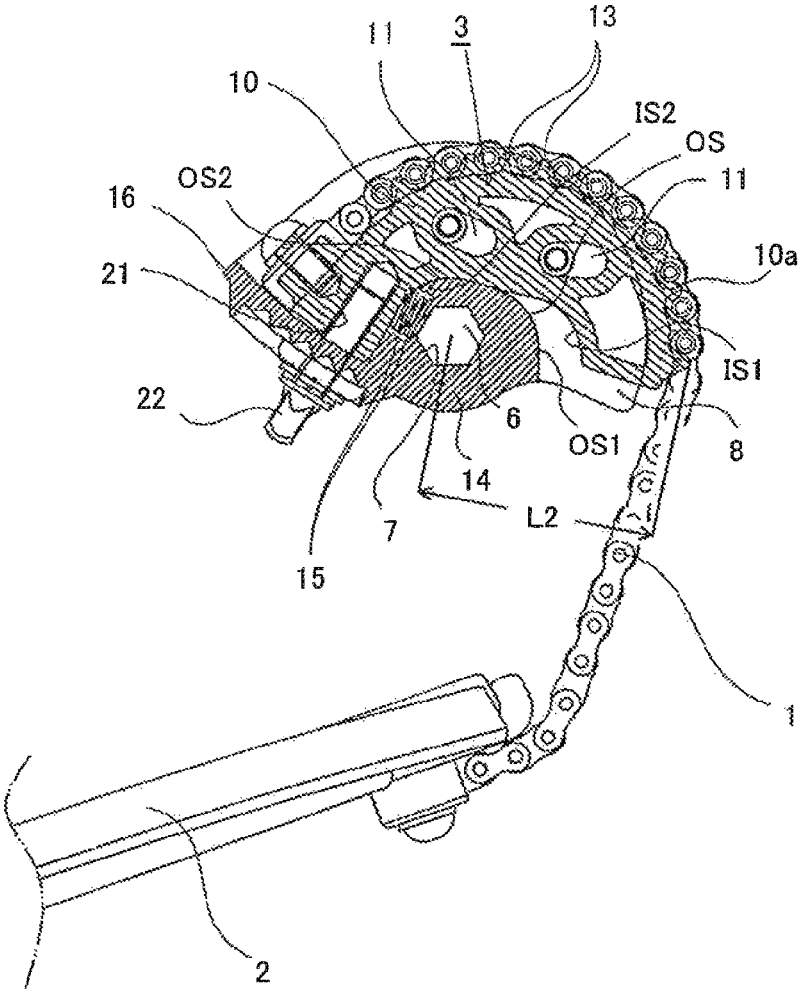
FIG. 2*b* is a sectional view of the multi-staged cam assembly with a maximum cam displacement from the driving shaft of the drum beater.
Figure 2C:
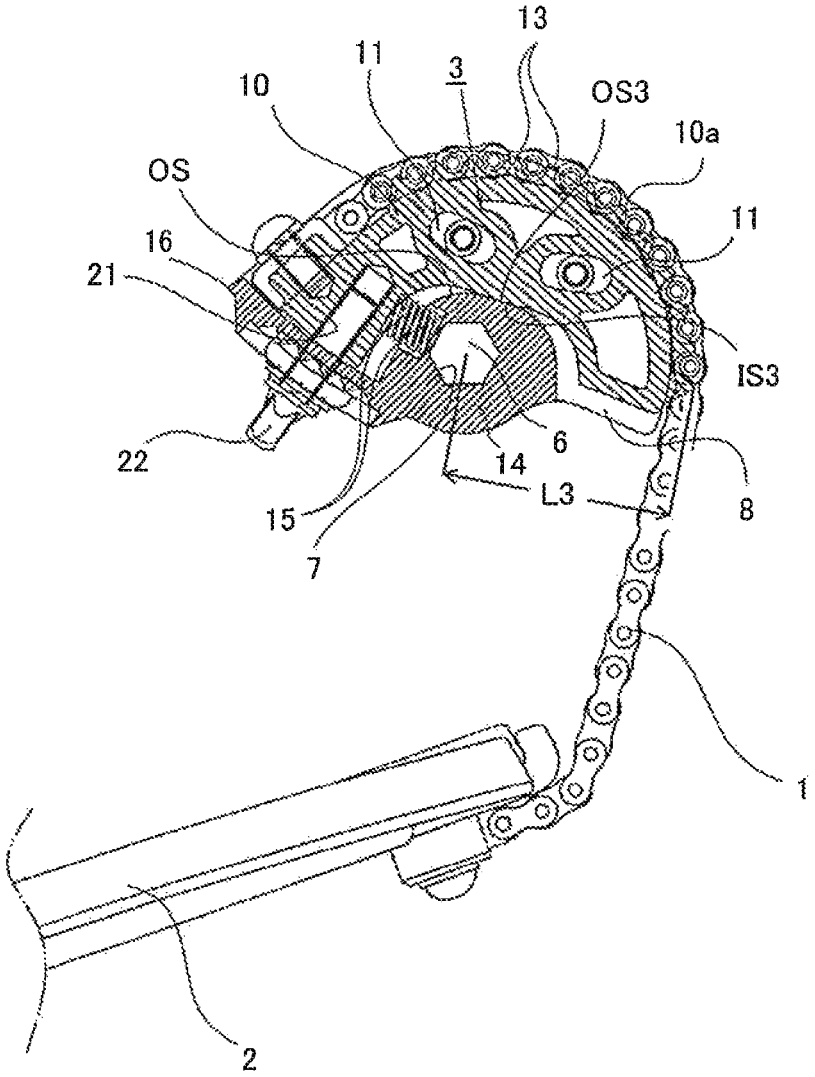
FIG. 2*c* is a sectional view of the multi-staged cam assembly with an intermediate cam displacement from the driving shaft of the drum beater.

A reference numeral "10" is an arc shaped cam 10 in which elongated holes 11, 11 for inserting guide pins 9, 9 are formed. The guide pins 9, 9 are secured to the side plates 8, 8, such that the cam 10 can be rotatably moved in a space formed between two side plates 8, 8. Sprockets 13, 13 for guiding the chain 1 are formed on an outer peripheral surface 10*a* of the cam 10. The other end of the chain 1 is secured to the front end (corresponding to a left in FIGS. 2*a*-2*c*) of the cam 10. The cam 10 has an inner peripheral surface IS which engages partially with an outer peripheral surface OS of the boss 14 (see FIGS. 2*a*-2*c*). As shown in FIGS. 2*a*-2*c*, the outer peripheral surface 10*a* of the cam 10 is formed in the arc of a perfect circle.

A reference numeral "15" is a pressed coil spring arranged between the outer peripheral surface OS of the boss 14 and the inner peripheral surface IS of the cam 10. A reference numeral "16" is a space keeping plate integrally formed with the boss 14 extending between the side plates 8, 8, where the arc shaped cam 10 is accommodated. The space keeping plate 16 restricts the cam moving forward such that the front face of the cam 10 is pressed against the back face of the space keeping plate 16. A plurality of grooves 18, which show a concave-convex pattern, are formed on almost the entire front surface of the space keeping plate 16 except an elongated hole 17 for inserting an adjusting bolt 22, which is formed in the middle of the space keeping plate 16. The grooves 18 of the space keeping plate 16 engage with counterpart grooves 19 formed on an adjusting plate 20. The adjusting bolt 22 is inserted through a hole formed in the adjusting plate 20 and the elongated hole 17, and then screwed in a screw hole 21 formed on the front face of the cam 10 in order to firmly fix the adjusting plate 20 to the space keeping plate 16.

Figure 3A:
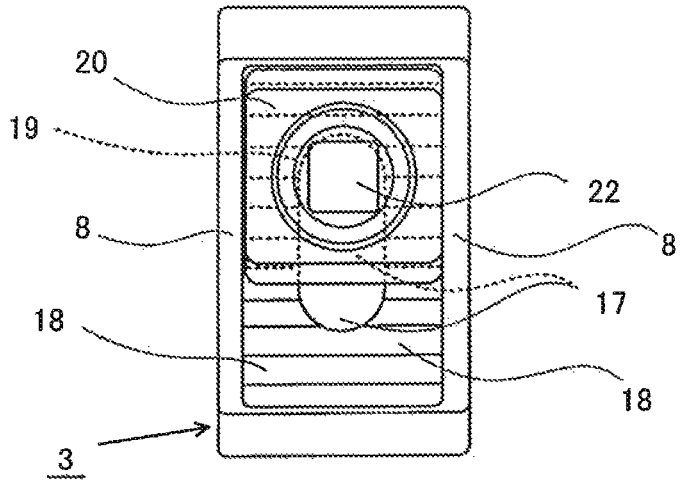
FIG. 3*a* is a partial enlarged view around an adjusting plate of the multi-staged cam assembly corresponding to FIG. 2*a*.

When the adjusting bolt 22 is located at the uppermost position in the elongated hole 17 as shown in FIG. 3*a*, a first outer peripheral surface OS1 of the outer peripheral surface OS of the boss 14 engages with a first inner peripheral surface IS1 of the inner peripheral surface IS of the cam 10 as shown in FIG. 2*a*. In this state, a length Lx from the center of the hole 7 of the boss 14 to the back end (a right end in FIGS. 2*a*-2*c*) of the cam 10, is the minimum length L1 (see FIG. 2*a*).

Figure 3B:
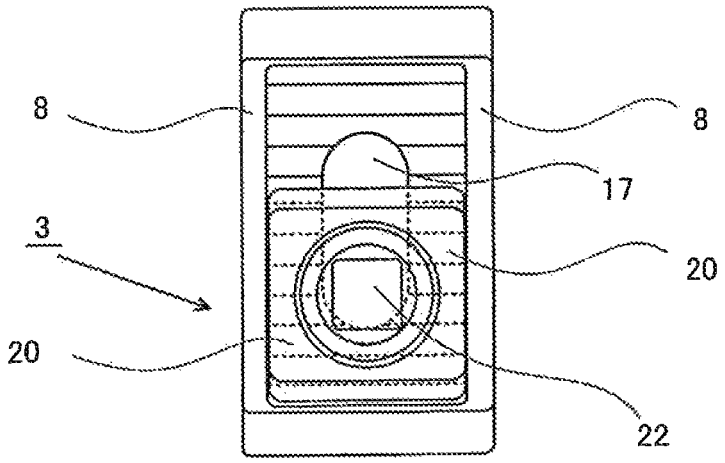
FIG. 3*b* is a partial enlarged view around the adjusting plate of the multi-staged cam assembly corresponding to FIG. 2*b*.

When the adjusting screw 22 is located at the lowermost position in the elongated hole 17 as shown in FIG. 3*b*, a second outer peripheral surface OS2 of the outer peripheral surface OS of the boss 14 engages with a second inner peripheral surface IS2 of the inner peripheral surface IS of the cam 10 as shown in FIG. 2*b*. In this state, the length Lx is the maximum length L2 (see FIG. 2*b*).

Figure 3C:
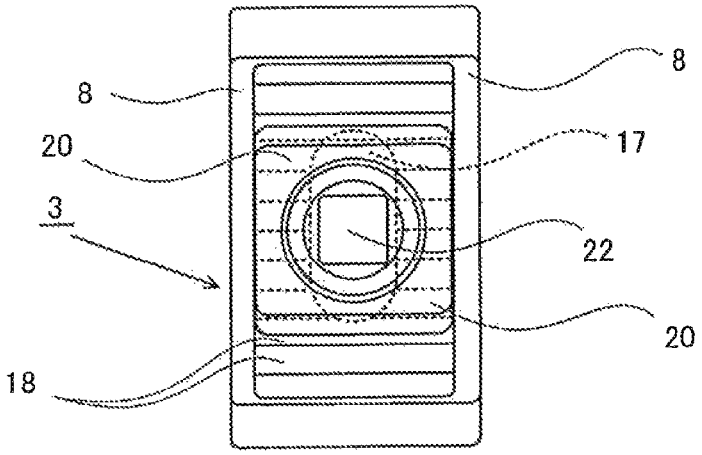
FIG. 3*c* is a partial enlarged view around the adjusting plate of the multi-staged cam assembly corresponding to FIG. 2*c*.

When the adjusting screw 22 is located at an intermediate position in the elongated hole 17 as shown in FIG. 3*c*, a third outer peripheral surface OS3 of the outer peripheral surface OS of the boss 14 engages with a third inner peripheral surface IS3 of the inner peripheral surface IS of the cam 10 as shown in FIG. 2*c*. In this state, the length Lx is an intermediate length L3 (see FIG. 2*c*).

The strongest drum beating force is attained when the length Lx is L1, and the weakest drum beating force is attained when the length Lx is L2, so that a desired drum beating force between the strongest and the weakest is attained by moving the adjusting bolt 22 to a proper position between the uppermost position and the lowermost position in the elongated hole 17.

In other words, the drummer can select a desired drum beating force by selecting a proper engaging status between the grooves 18 and the counterpart grooves 19 and fixing the proper engaging status by screwing the adjusting bolt 22.

The drummer selects a proper engaging status between the grooves 18 of the space keeping plate 16 and the counterpart grooves 19 of the adjusting plate 20 by moving the adjusting bolt 22 along the elongated hole 17 and fixes the selected engaged status by screwing the adjusting bolt 22 in the screw hole 21 formed on the front face of the cam 10.

Figure 4:
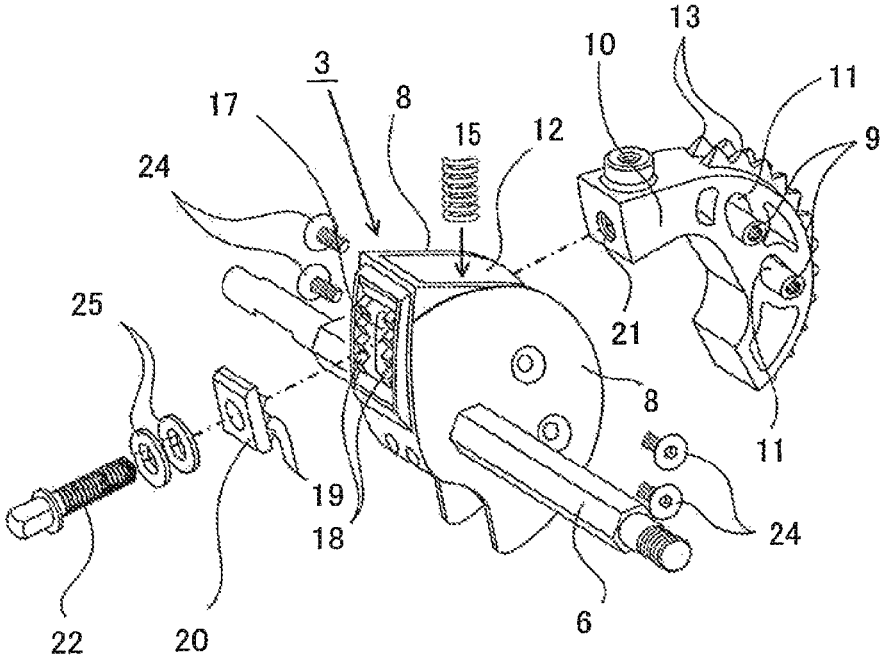
FIG. 4 is an exploded perspective view of the multi-staged cam assembly.

Further a reference numeral "23" in FIG. 1 is a spring mechanism suspended from the drive shaft 6 for returning the drive shaft 6 to the original position when the drummer stops stamping the stamping pedal 2. A reference numeral "24" in FIG. 4 is screws to secure the guide pins 9, 9 to the side plates 8, 8. A reference numeral "25" in FIG. 4 is washers for the adjusting bolt 22.

When the drummer stamps the stamping pedal 2, the chain 1 is dragged downward. The revolving body 3 is revolved around the hole 7 of the boss 14 by the dragging movement of the chain 1, so that the drive shaft 6 is revolved together with the drum beating rod 5, which gives proper pressing force to the drum.

When the drummer stops stamping the pedal 2, the drum beating rod 5 is returned to the original position by a dragging force of the spring mechanism 23.

The drum beating force can be more finely adjusted by reducing an engaging pitch between the grooves 18 on the space keeping plate 16 and the counterpart grooves 19 on the adjusting plate 20.

As explained above, the drum player can select a desired beating force by adjusting the length Lx between the minimum length L1 for the strongest beating force to the maximum length L2 for the weakest beating force as keeping the foot board angle almost unchanged.

Thus, finely adjusted drum beating force subtly affects the melody of a played tune, so that the profound tune of better quality can be attained.

Other embodiments, where a belt is employed as the connecting element instead of the chain, are possible. In this case the sprockets on the cam are not necessary, so that a smooth outer peripheral surface of the cam can be used.

REFERENCE NUMERALS AND CHARACTERS

1 Chain(s) (Connecting element)
2 Stamping pedal
3 Revolving body
4 Supporting body
5 Drum beating rod
6 Drive shaft
7 Hole (formed in the boss 14)
8 Side plate(s)
9 Guide pin(s)
10 Arc shaped cam
10*a* Outer peripheral surface (of the arc cam 10)

11 Elongated hole(s) (formed in the arc cam 10)
12 Space between the two side plates 8, 8
13 Sprocket(s) (formed on the arc cam 10)
14 Boss
15 Coil spring
16 Space keeping plate (for the arc cam 10)
17 Elongated hole (formed in the space keeping plate 16)
18 Groove(s) (formed on the space keeping plate 16)
19 Counterpart groove(s) (formed on the adjusting plate 20)
20 Adjusting plate
21 Screw hole
22 Adjusting bolt
23 Spring mechanism
24 Screw(s) (for securing the guide pin(s) 9)
25 Washer(s) (for the adjusting bolt)
IS Inner peripheral surface of the arc cam 10
IS1: First inner peripheral surface
IS2: Second inner peripheral surface
IS3: Third inner peripheral surface
OS Outer peripheral surface of the boss 14
OS1: First outer peripheral surface
OS2: Second outer peripheral surface
OS3: Third outer peripheral surface
Lx Distance from the hole 7 of the boss to the front end of the arc cam
L1: Minimum length
L2: Maximum length
L3: Intermediate length

What is claimed is:

1. A multi-staged cam assembly for a drum pedal, comprising:

a connecting element of which one end is secured to a tip of a stamping pedal;

an arc shaped cam of which a front end is secured to the other end of the connecting element, wherein the connecting element is guided along an outer peripheral surface of the cam;

a drive shaft to which a drum beating rod is fixed; and a revolving body comprising a boss and a space keeping plate which restricts the cam from moving forward, wherein a hole through which the drive shaft passes is formed in the center of the boss; wherein:

an elongated hole is formed in the middle of the space keeping plate;

a screw hole is formed in the front face of the cam at a position corresponding to the elongated hole of the space keeping plate;

a bolt is inserted in the elongated hole and screwed in the screw hole in the front face of the cam, such the cam is fixed at a desired position; and a length from the center of the hole of the boss to the back end of the cam is varied in a multi-staged way according to the fixed position of the bolt in the elongated hole.

2. The multi-staged cam assembly according to claim 1, wherein:

a plurality of grooves with a concave-convex pattern are formed on the front face of the space keeping plate;

a plurality of counterpart grooves to be engaged with the grooves are formed on an adjusting plate to be attached to the front face of the space keeping plate; and the bolt is screwed in the screw hole of the front face of the cam after being inserted in a hole formed in the adjusting plate and in the elongated hole of the space keeping plate so as to fix the bolt.

3. The multi-staged cam assembly according to claim 1, wherein:

the inner peripheral surface of the cam is formed so as to be engaged with the outer peripheral surface of the boss.

4. The multi-staged cam assembly according to claim 1, wherein:

a pressed coil spring is arranged between the inner peripheral surface of the cam and the outer peripheral surface of the boss.

* * * * *